United States Patent [19]

Sepulveda et al.

[11] Patent Number: 4,954,286

[45] Date of Patent: Sep. 4, 1990

[54] FABRIC PRETREATMENT CLEANING COMPOSITIONS

[75] Inventors: Ralph R. Sepulveda, Suffern, N.Y.; Jesse L. Lynn, Jr., Oradell, N.J.

[73] Assignee: Lever Brothers Company, New York, N.Y.

[21] Appl. No.: 181,287

[22] Filed: Apr. 14, 1988

[51] Int. Cl.[5] ..... C11D 1/835; C11D 1/72

[52] U.S. Cl. ..... 252/174.22; 252/170; 424/45

[58] Field of Search ..... 252/174.22, 170; 424/45

[56] References Cited

U.S. PATENT DOCUMENTS

| | | | |
|---|---|---|---|
| 3,663,445 | 5/1972 | Augustin | 252/117 |
| 3,870,647 | 3/1975 | Travers | 252/118 |
| 4,079,078 | 3/1978 | Collins | 252/545 |
| 4,201,686 | 5/1980 | Augustijn | 252/174.22 |
| 4,243,546 | 1/1981 | Shaer | 252/174.12 |
| 4,288,339 | 9/1981 | Wilsberg | 252/90 |
| 4,438,009 | 3/1984 | Brusky | 252/90 |
| 4,530,781 | 7/1985 | Gipp | 252/546 |
| 4,595,527 | 6/1986 | Gipp | 252/546 |
| 4,652,389 | 3/1987 | Moll | 252/90 |

FOREIGN PATENT DOCUMENTS

| | | |
|---|---|---|
| 40882 | 12/1981 | European Pat. Off. . |
| 105063 | 4/1984 | European Pat. Off. . |
| 1692011 | 7/1971 | Fed. Rep. of Germany . |
| 2144763 | 3/1985 | United Kingdom . |
| 2178441 | 2/1987 | United Kingdom . |

OTHER PUBLICATIONS

Rosen, M. J., *Surfactants and Interfacial Phenomena*, N.Y., John Wiley & Sons, 1978, pp. 242–245.

*Primary Examiner*—John F. Niebling
*Assistant Examiner*—Isabelle Rodriguez
*Attorney, Agent, or Firm*—Milton L. Honig

[57] ABSTRACT

An aqueous clear, homogeneous liquid composition is provided for the pretreatment of fabric in advance of laundering. The composition includes a mixture of non-ionic surfactants with a respective HLB less than 10 and greater than 10. Also present will be a hydrocarbon solvent and the salt of a $C_{12}$–$C_{22}$ fatty acid. One embodiment of the composition is an aerosol mousse discharging as a foam that will a number of times alternately expand and collapse.

15 Claims, No Drawings

FABRIC PRETREATMENT CLEANING COMPOSITIONS

BACKGROUND OF THE INVENTION

1. Field of the Invention

The invention relates to pretreatment compositions for the cleaning of fabrics, especially aerosol mousse and liquid spray type products.

2. The Prior Art

The present invention is concerned with laundry pretreater compositions in either aerosol mousse or liquid spray form. Both of these forms require formulation of homogeneous compositions.

Laundry pretreaters or prespotters are designed to aid in the removal of recalcitrant stains. They are used neat on the stain prior to the garment being washed in a machine with laundry detergent and other additives. Particularly recalcitrant stains are those of grease and oil, ground-in dirt (clay), blood and other proteinaceous stains such as those caused by grass.

Aerosol products of every description, and most recently aerosol mousses discharged by inverting, are very popular in the marketplace. Aerosols are popular because they are easily pointed. Sometimes consumers are instructed to vigorously shake these products before using. If consumers fail to shake, the discharge of an unhomogeneous dosage may result in poor product performance, even unsafe performance due to imbalance of composition ingredients.

Likewise, during manufacture, compositions that are not homogeneous would have to be kept so with constant stirring and circulation of ingredients during container filling operation. Without homogeneity, the aerosol unit could not be dosed with the correct unit amount of ingredients. Precautions to insure homogeneity are quite burdensome. Thus, there is a need for stable uniform liquid compositions.

U.S. Pat. No. 4,652,389 (Moll) describes a foaming aerosol composition for the cleaning of carpet. Primary components include a solvent with consistent evaporation rate, a surfactant, and a propellant, all in an aqueous system. Solvent and surfactant admixture interact with the propellant to form an initial foam upon dispensing. The foam then collapses into the carpet followed by a secondary re-foaming.

An aqueous laundry prespotting composition is described in U.S. Pat. No. 4,595,527 (Gipp) which reports achieving satisfactory oily stain removal in an essentially organic solvent free media. Evidently crucial to the success of this prespotter is the presence of a chelating agent such as ethylenediaminetetraacetic acid or citric acid salts and at least one nonionic solvent such that total surfactant HLB ranges from 9 to 13. Surfactant mixtures are suggested which include Neodol 25-7 ® and Neodol 25-3 ® identified as $C_{12}$–$C_{15}$ linear alcohol ethoxylates with, respectively, 7 and 3 moles ethylene oxide per alcohol unit.

Prespotting compositions are disclosed in U.S. Pat. No. 4,438,009 (Brusky et al.) which were said to exhibit special effectiveness against both oil and water-borne stains while utilizing a relatively low percentage of solvent. Success of this composition was attributed to a surfactant mixture of sorbitan fatty acid, ethoxylated nonylphenol or alcohol, and ethoxylated sorbitan fatty acid. Total HLB of the surfactant combination must range between 8.5 and 10.5.

U.S. Pat. No. 4,530,781 (Gipp) reports metastable prespotting compositions comprising a chelating agent, an organic solvent, at least one nonionic surfactant, and water. The formulation typically forms at least two phases which are readily redispersed by shaking to provide a metastable composition. Example 1 lists a combination of four surfactants including sorbitan monooleate, ethoxylated sorbitan monooleate, nonylphenol ethoxylate (6 moles EO) and nonylphenol ethoxylate (3.5 moles EO). An isoparaffinic hydrocarbon, EDTA, citric acid, and water round out the formulation.

Evident from the aforecited art is that considerable technology is available with respect to laundry prespotting and pretreatment. Nevertheless, it is also evident that the known formulations have not been optimized for use with aerosol mousse and spray liquid type products.

Accordingly, it is an object of the present invention to provide an aerosol mousse or spray liquid cleaning composition for the pretreatment of fabric which has superior soil removal properties for a wide variety of stains.

Another object of the present invention is to provide a laundry pretreater composition containing both water and hydrocarbon solvent which components form into a clear homogeneous liquid that allows for uniform dosing in manufacturing and dispensing.

A still further object of the present invention is to provide an aerosol mousse type product that upon discharge forms a foam that alternately in repeating series peaks (expands) and collapses before foam dissipation.

These and other objects of the present invention will become more apparent from the following more detailed description.

SUMMARY OF THE INVENTION

An aqueous, clear homogeneous liquid is disclosed comprising:

(a) from 1 to 20% of a mixture of surfactants comprising:

( i) a first ethoxylated nonionic surfactant having an HLB less than 10; and (ii) a second ethoxylated nonionic surfactant having an HLB greater than 10;

the ratio of (i) to (ii) being 3:1 to 1:3;

(b) from 1 to 30% of a hydrocarbon solvent; and (c) from 1 to 20% of a salt of a $C_{12}$–$C_{22}$ fatty acid.

Other components useful in the formulation include chelating agents such as EDTA and coupling agents such as isopropanol and sodium xylene sulfonate. "Dancing" foam may best be achieved by having a propellant in an amount at least 20% by weight of the total composition. A particularly preferred fatty acid salt is that of triethanolamine oleate formed from triethanolamine and oleic fatty acids.

DETAILED DESCRIPTION OF THE INVENTION

Compositions of this invention which must compatibilize water and hydrophobic solvent were found to require a special combination of nonionic surfactant. The combination must include a pair of ethoxylated nonionic detergent actives. The first of these actives must have an HLB of less than 10, preferably less than 8. Illustrative of the first type nonionic are alkoxylated $C_9$–$C_{18}$ alkyl fatty alcohols and alkoxylated $C_6$–$C_{12}$ alkyl phenols. Especially preferred are $C_{12}$–$C_{15}$ fatty alcohols ethoxylated with an average 3 moles ethylene oxide (EO) such as in Neodol 25-3 ®.

A second type nonionic detergent active required for the composition is one which has an HLB of greater than 10, preferably at least 13. Illustrative of the second type detergent active are higher alkoxylated $C_9$–$C_{18}$ alkyl fatty alcohol and lower alkoxylated $C_6$–$C_{12}$ alkyl phenol. Especially preferred within this category are $C_{12}$–$C_{15}$ alcohol ethoxylated with an average 9 moles ethylene oxide (EO) such as Neodol 25-9 ®.

Amount of first to second ethoxylated nonionic surfactant will range in a ratio from about 3:1 to 1:3, preferably 2:1 to 1:2, optimally 1:1.

The compositions of this invention are intended to be effective against both hydrophilic and hydrophobic stains. As a consequence, the formulation will contain water as a carrier for the hydrophilic and hydrocarbon solvent as a carrier for the hydrophobic stains. Water may range in an amount from 10 up to 80%, preferably between 15 and 50%, optimally between 20 and 40%. The hydrocarbon solvent may be present from about 1 to 30%, preferably from 5 to 20%, optimally around 10%.

Hydrocarbon solvent is considered to be any hydrophobic organic liquid having at least moderate volatility. Within this category may be included such hydrocarbon solvents as deodorized kerosene, solvent naphtha, terpenes and chlorinated hydrocarbons. Within the kerosene and solvent naphtha category there may be included paraffins, naphthenes, aromatics, olefins and isoparaffins. Chlorinated solvents include 1,1,1-trichloroethane, perchloroethylene and methylene chloride. Particularly preferred are the hydrocarbon solvents such as Shellsol 71 ® and Shell 460 Solvent ®.

The salts of $C_{12}$–$C_{22}$ fatty acid, i.e. soap, is a further important component. Sodium soap may be utilized but the amine type soaps have been found to have special advantage. This component aids in stain removal and helps achieve homogeneity. More than this, however, the soap forms a film around the propellant of the composition entrapping propellant and thereby assisting in the foam delay. Particularly effective are the ammonium and alkanolammonium, including the triethanolammonium, salt of $C_{12}$–$C_{22}$ fatty acid. Oleic fatty acids are preferred. Most effective has been found to be the triethanolammonium salt of oleic acid which combination can be formed in situ from triethanolamine and free oleic acid present in equimolar proportion.

Soap will be present in the composition in an amount from about 0.5 to 10%, preferably from about 2 to 4%, optimally around 3%.

Coupling agents are also desirably present in the formulation. Amounts of these agents may range from about 1% to 20%, preferably from 8% to 20%, optimally around 15%. As the name implies, the coupling agent helps to compatibilize various components of the composition. Suitable materials for this purpose are $C_1$–$C_4$ alkanols and sodium $C_1$–$C_4$ alkyl phenol sulfonate salts. Examples of these materials are ethanol, isopropanol, sodium xylene sulfonate and sodium toluene sulfonate. The sulfonates also aid in low temperature stability connected with the freeze-thaw cycles. Isopropanol also performs the dual function of being a foam depressant.

Builders, especially those of the chelating variety, may be employed with formulations of the invention. Examples of such builders include sodium ethylenediaminetetraacetate (EDTA) available as Trilon B ®, sodium citrate, and phosphonic acid derivatives such as the Dequest ® products. Builder will normally be present in amounts ranging from 0.5 to about 20%, preferably from 1 to 5%, optimally around 3%.

Enzymes may also be included in the compositions. These enzymes may include proteases, amylases, lipases, cellulases and combinations thereof. When present, the enzymes will range in amount from about 0.005 to about 5%, preferably from about 0.1 to 3%, optimally around 1%. Normally, the presence of enzymes also requires the presence of stabilizing agents. Among such agents are hydrated sodium borate and/or propylene glycol. These stabilizers will be present in amounts anywhere from 0.1% up to 20%, preferably from 1% to 15%, optimally around 10%.

Aerosol mousse compositions of this invention will also require the presence of a propellant to deliver and build the first foam. Although not limited to, the propellant usually is a $C_1$–$C_{10}$ hydrocarbon such as methane, ethane, n-propane, n-butane, isobutane, n-pentane or isopentane and mixtures thereof. Halogenated hydrocarbons may also be utilized but these are not preferred because of environmental problems. The amount of propellant relative to the combined other ingredients will range from about 4:1 to 1:4, preferably about 2:1 to 1:1, optimally about 3:2. Where the aerosol mousse is required to "dance" having alternate foam expansion and collapse, it is necessary to have a minimum of 20% and maximum of 80% propellant by weight of the total composition.

Other important aspects of the invention include the pH which normally should range from about 7.5 up to 10, preferably between 8.5 and 9.5, optimally about 9.0.

The following examples will more fully illustrate the embodiments of this invention. All parts, percentages and proportions referred to herein and in the appended claims are by weight unless otherwise illustrated.

EXAMPLE 1

The present invention is illustrated by a typical aerosol mousse concentrate outlined in the Table below. This concentrate is intended to be combined with a propellant such as A31 ® in a ratio of 2:3, respectively.

TABLE I

Mousse Concentrate

| Component | % Active |
|---|---|
| Isopropyl alcohol | 13.0 |
| Shell 460 Solvent ®* | 10.0 |
| Propylene glycol | 10.0 |
| Neodol 25-3 ($C_{12-15}$ + 3 EO alcohol ethoxylate) | 6.0 |
| Neodol 25-9 ($C_{12-15}$ + 9 EO alcohol ethoxylate) | 6.0 |
| Sodium borate decahydrate | 2.5 |
| Sodium xylene sulfonate | 2.4 |
| Oleic fatty acid | 2.0 |
| Triethanolamine | 1.05 |
| Savinase (enzyme) | 1.0 |
| Perfume | 0.3 |
| Water | up to 100% |

*A complex mixture of kerosene 20–30% and solvent naphtha 70–80%; combination contains 63% paraffins, 27% naphthenes, 9% aromatics, and 1% olefins.

TABLE 11

Spray Liquid

| Component | % Active |
|---|---|
| Shell 460 Solvent ® | 33.0 |
| Neodol 25-3 ($C_{12-15}$ + 3 EO alcohol ethoxylate) | 16.1 |
| Neodol 25-9 ($C_{12-15}$ + 9 EO alcohol ethoxylate) | 16.1 |
| Isopropyl alcohol | 12.7 |

TABLE 11-continued

| Component | Spray Liquid % Active |
|---|---|
| Oleic fatty acid | 5.7 |
| Triethanolamine | 3.0 |
| Perfume | 0.4 |
| Water | up to 100% |

EXAMPLE 2

This Example investigates the effect of surfactant on achieving a clear homogeneous liquid concentrate. The mousse concentrate of Example 1 was utilized as the base formulation except that the Neodol ® surfactants were varied. Table III lists the results of this study.

TABLE III

| Surfactant | HLB Number | Effects of Surfactant Experiment (% surfactant) A | B | C | D |
|---|---|---|---|---|---|
| Neodol 25-3 ® | 7.9 | 6.0 | 12.0 | — | — |

TABLE III-continued

| Surfactant | HLB Number | Effects of Surfactant Experiment (% surfactant) A | B | C | D |
|---|---|---|---|---|---|
| Neodol 25-9 ® | 12.0 | 6.0 | — | 12.0 | — |
| Neodol 23-6.5 ® | 13.3 | — | — | — | 12.0 |
| Homogeneity: | | Yes | Phase Separation | Phase Separation | Phase Separation |

From Table III, it is evident that a combination of both Neodol 25-3 ® and Neodol 25-9 ® are required to obtain a clear homogeneous liquid. Use of Neodol 23-6.5 ® or the other Neodol ® materials separately gave formulations that caused phase separation. Evidently, HLB of the total composition is not the key factor in ensuring phase stability.

EXAMPLE 3

Various formulation changes were investigated. These are reported in Table IV.

TABLE IV

| Component | Formulation No. (% component) 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Neodol 25-9 ® | 3 | 3 | 3 | 3 | 3 | 10 | — | — | — | 6 | — | 6 | 6 | 6 | 3 |
| Neodol 25-3 ® | 7 | 7 | 7 | 7 | 7 | — | 10 | — | — | 6 | 6 | — | 6 | 6 | 7 |
| Neodol 91-6 ® | — | — | — | — | — | — | — | 10 | — | — | — | — | — | — | — |
| Neodol 91-2.5 ® | — | — | — | — | — | — | — | — | 10 | — | — | — | — | — | — |
| Igepal CO-210 | — | — | — | — | — | — | — | — | — | — | — | — | — | — | — |
| Igepal CO-630 | — | — | — | — | — | — | — | — | — | — | — | — | — | — | — |
| Igepal CA-420 | — | — | — | — | — | — | — | — | — | — | — | — | — | — | — |
| Gafac RB-400 | — | — | — | — | — | — | — | — | — | — | — | — | — | — | — |
| Gafac RA-600 | — | — | — | — | — | — | — | — | — | — | — | — | — | — | — |
| Gafac RE-610 | — | — | — | — | — | — | — | — | — | — | — | — | — | — | 13 |
| Varsulf SBFA 50 | — | — | — | — | — | — | — | — | — | — | — | — | — | — | — |
| Isopropanol | 10 | 10 | 10 | 10 | 10 | 10 | 10 | 10 | 10 | 13 | 8 | 8 | 11.4 | 13 | 13 |
| Sodium Xylene Sulfonate | 2 | 2 | 2 | 2 | 2 | 2 | 2 | 2 | 2 | 2.4 | 2.4 | 2.4 | 4 | 2.4 | 2.4 |
| Sodium Citrate | 2 | 1 | 3 | — | — | 3 | 3 | 3 | — | 3 | 3 | 3 | 3 | 3 | 3 |
| Trilon B ® | — | — | — | — | — | — | — | — | — | — | — | — | — | — | — |
| Dequest 200T ® | — | — | — | 3 | — | — | — | — | — | — | — | — | — | — | |
| Versene 100 ® | — | — | — | — | 3 | — | — | — | — | — | — | — | — | — | — |
| Triethanolamine | 1.05 | 1.05 | 1.05 | 1.05 | 1.05 | 1.05 | 1.05 | 1.05 | 1.05 | 1.05 | 1.05 | 1.05 | 1.05 | 1.05 | 1.05 |
| Oleic Fatty Acid | 2 | 2 | 2 | 2 | 2 | 2 | 2 | 2 | 2 | 2 | 2 | 2 | 2 | 2 | 2 |
| Zeolite Water | | | | | | | | to 100 | | | | | | | |
| Shellsol 71 ® | — | — | — | — | — | — | — | — | — | 5 | 5 | 5 | 7.5 | 10 | 5 |
| Lauric Monoethanolamide | — | — | — | — | — | — | — | — | — | — | — | — | — | — | — |
| Savinase/ $CaCl_2.2H_2O$ | — | — | — | — | — | — | — | — | — | — | — | — | — | — | — |
| Sodium Borate Decahydrate | — | — | — | — | — | — | — | — | — | — | — | — | — | — | — |
| Propylene Glycol | — | — | — | — | — | — | — | — | — | — | — | — | — | — | — |
| Homogeneity: | Yes | Yes | Yes | No | Yes | Yes | Yes | Yes | No | Yes | No | No | Yes | Yes | Yes |

| Surfactant Descriptives | | EO | HLB |
|---|---|---|---|
| Igepal CO 210 | nonylphenolethoxylate | 1.5 | 4.5 |
| Igepal CO 630 | nonylphenolethoxylate | 9 | 13 |
| Igepal CA 420 | octylphenolethoxylate | 1.5 | 4.8 |
| Gafac RA 600 | acid polyphosphoric ester aliphatic hydrophobic base | | |
| Gafac RE 610 | acid polyphosphoric ester aromatic hydrophobic base (nonylphenol) | | |
| Gafac RB 400 | acid polyphosphoric ester aliphatic hydrophobic base (oleyl) | | |

| Component | Formulation No. (% component) 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|
| Noedol 25-9 ® | 3 | 3 | 12 | 5 | 5 | 5 | 5 | 5 | 12 | — | — | 6 | — | — | — |
| Neodol 25-3 ® | 7 | 7 | — | 7 | 7 | 7 | 7 | 7 | — | — | 6 | — | — | — | — |
| Neodol 91-6 ® | — | — | — | — | — | — | — | — | — | — | — | — | — | — | — |
| Neodol 91-2.5 ® | — | — | — | — | — | — | — | — | — | — | — | — | — | — | — |
| Igepal CO-210 | — | — | — | — | — | — | — | — | — | 6 | — | — | 6 | 6 | 6 |

TABLE IV-continued

| | | | | | | | | | | | | | | | |
|---|---|---|---|---|---|---|---|---|---|---|---|---|---|---|---|
| Igepal CO-630 | — | — | — | — | — | — | — | — | — | 6 | 6 | — | — | — | — |
| Igepal CA-420 | — | — | — | — | — | — | — | — | — | — | — | 6 | — | — | — |
| Gafac RB-400 | — | — | — | — | — | — | — | — | — | — | — | — | 6 | — | — |
| Gafac RA-600 | — | — | — | — | — | — | — | — | — | — | — | — | — | 6 | — |
| Gafac RE-610 | — | — | — | — | — | — | — | — | — | — | — | — | — | — | 6 |
| Varsulf SBFA 50 | — | — | — | — | — | — | — | — | — | — | — | — | — | — | — |
| Isopropanol | 13 | 13 | 13 | 10 | 10 | 9 | 10 | 10 | 13 | 7 | 7 | 7 | 7 | 7 | 7 |
| Sodium Xylene Sulfonate | 2.4 | 2.4 | 2.4 | 2.4 | 2.4 | 2.4 | 2.4 | 2.4 | 2.4 | 2.4 | — | 2.4 | 2.4 | 2.4 | 2.4 |
| Sodium Citrate | — | — | — | — | — | — | — | — | 3 | — | — | — | — | — | — |
| Trilon B ® | 3 | 3 | 3 | 3 | 3 | 3 | 3 | 3 | — | 1 | — | 3 | 3 | 3 | 3 |
| Dequest 200T ® | — | — | — | — | — | — | — | — | — | — | — | — | — | — | — |
| Versene 100 ® | — | — | — | — | — | — | — | — | — | — | — | — | — | — | — |
| Triethanolamine | 1.05 | 1.05 | 1.05 | 1.05 | 0.525 | — | 0.525 | 1.0 | 1.05 | 1.05 | 1.05 | 1.05 | 1.05 | 1.05 | 1.05 |
| Oleic Fatty Acid | 2 | 2 | 2 | 2 | 1.0 | — | 1.0 | — | 2 | 2 | 2 | 2 | 2 | 2 | 2 |
| Zeolite Water | | | | | | | | to 100 | | | | | | | |
| Shellsol 71 ® | 5 | 10 | 10 | 10 | 10 | 10 | 10 | 10 | 5 | 10 | — | 10 | 10 | 10 | 10 |
| Lauric Mono-ethanolamide | — | — | — | — | — | — | 6.5 | — | — | — | — | — | — | — | — |
| Savinase/ $CaCl_2.2H_2O$ | — | — | — | — | — | — | — | — | — | 1 | — | 1 | 1 | 1 | 1 |
| Sodium Borate Decahydrate | — | — | — | — | — | — | — | — | — | 2.5 | 2.5 | 2.5 | 2.5 | 2.5 | 2.5 |
| Propylene Glycol | — | — | — | — | — | — | — | — | — | 10 | 10 | 10 | 10 | 10 | 10 |
| Homogeneity: | Yes | Yes | No | Yes | Yes | Yes | Yes | Yes | No | Yes | Yes | Yes | Yes | Yes | Yes |

| Surfactant Descriptives | | EO | HLB |
|---|---|---|---|
| Igepal CO 210 | nonylphenolethoxylate | 1.5 | 4.5 |
| Igepal CO 630 | nonylphenolethoxylate | 9 | 13 |
| Igepal CA 420 | octylphenolethoxylate | 1.5 | 4.8 |
| Gafac RA 600 | acid polyphosphoric ester aliphatic hydrophobic base | | |
| Gafac RE 610 | acid polyphosphoric ester aromatic hydrophobic base (nonylphenol) | | |
| Gafac RB 400 | acid polyphosphoric ester aliphatic hydrophobic base (oleyl) | | |

| | Formulation No. (% component) | | | | | | | | | | | | |
|---|---|---|---|---|---|---|---|---|---|---|---|---|---|
| Component | 31 | 32 | 33 | 34 | 35 | 36 | 37 | 38 | 39 | 40 | 41 | 42 | 43 |
| Neodol 25-9 ® | — | 6 | 6 | 6 | 6 | 6 | 6 | 6 | 6 | 6 | 5 | 12 | 12 |
| Neodol 25-3 ® | — | 6 | 6 | 6 | 6 | 6 | 6 | 6 | 6 | 6 | 5 | 12 | 12 |
| Neodol 91-6 ® | — | — | — | — | — | — | — | — | — | — | — | — | — |
| Neodol 91-2.5 ® | — | — | — | — | — | — | — | — | — | — | — | — | — |
| Igepal CO-210 | 6 | — | — | — | — | — | — | — | — | — | — | — | — |
| Igepal CO-630 | — | — | — | — | — | — | — | — | — | — | — | — | — |
| Igepal CA-420 | — | — | — | — | — | — | — | — | — | — | — | — | — |
| Gafac RB-400 | — | — | — | — | — | — | — | — | — | — | — | — | — |
| Gafac RA-600 | — | — | — | — | — | — | — | — | — | — | — | — | — |
| Gafac RE-610 | — | — | — | — | — | — | — | — | — | — | — | — | — |
| Varsulf SBFA 50 | 6 | — | — | — | — | — | — | — | — | — | — | — | — |
| Isopropanol | 7 | 7 | 7 | 7 | 7 | 7 | 7 | 7 | 7 | 7 | 7 | 7 | 7 |
| Sodium Xylene Sulfonate | 2.4 | 2.4 | 2.4 | 2.4 | 2.4 | 2.4 | 2.4 | 2.4 | 2.4 | 2.4 | 2.4 | 2.4 | 2.4 |
| Sodium Citrate | — | — | — | — | — | — | — | — | — | — | — | — | — |
| Trilon B ® | 3 | 2 | 3 | 6 | 3 | 3 | 3 | 3 | 3 | 3 | 3 | 3 | 3 |
| Dequest 200T ® | — | — | — | — | — | — | — | — | — | — | — | — | — |
| Versene 100 ® | — | — | — | — | — | — | — | — | — | — | — | — | — |
| Triethanolamine | 1.05 | 1.03 | 1.05 | 1.05 | 1.03 | 2.1 | 3.15 | 1.05 | 1.05 | 3.15 | 1.05 | 1.05 | 1.05 |
| Oleic Fatty Acid | 2 | 2 | 2 | 2 | 1 | 4 | 6 | 2 | — | 6 | 2 | 6 | 6 |
| Zeolite Water | | | | | | | to 100 | | | | | | |
| Shellsol 71 ® | 10 | 10 | 2 | 10 | 10 | 10 | 10 | 12.5 | 10 | 15 | 10 | 10 | 15 |
| Lauric Mono-ethanolamide | — | — | — | — | — | — | — | — | — | — | — | — | — |
| Savinase/ $CaCl_2.2H_2O$ | 1 | 1 | 1 | 1 | 1 | 1 | 1 | 1 | 1 | 1 | 1 | 1 | 1 |
| Sodium Borate Decahydrate | 2.5 | 2.5 | 2.5 | 2.5 | 2.5 | 2.5 | 2.5 | 2.5 | 2.5 | 2.5 | 2.5 | 2.5 | 2.5 |
| Propylene Glycol | 10 | 10 | 10 | 10 | 10 | 10 | 10 | 10 | 10 | 10 | 10 | 10 | 10 |
| Homogeneity: | No | Yes | Yes | Yes | Yes | Yes | Yes | Yes | Yes* | Yes | Yes | No | No |

| Surfactant Descriptives | | EO | HLB |
|---|---|---|---|
| Igepal CO 210 | nonylphenolethoxylate | 1.5 | 4.5 |
| Igepal CO 630 | nonylphenolethoxylate | 9 | 13 |
| Igepal CA 420 | octylphenolethoxylate | 1.5 | 4.8 |
| Gafac RA 600 | acid polyphosphoric ester aliphatic hydrophobic base | | |
| Gafac RE 610 | aromatic hydrophobic base (nonylphenol) | | |
| Gafac RB 400 | acid polyphosphoric ester | | |

TABLE IV-continued

| | |
|---|---|
| | aliphatic hydrophobic base (oleyl) |

*Unsatisfactory at low temperature

Formulations 1–9 illustrate compositions where the organic solvent has been omitted. Without Shellsol 71®, it is sufficient to have a single surfactant, i.e. Neodol 25-9®, to achieve homogeneity as shown in Formulation 6. Of course, not all surfactants even in the absence of a solvent will lead to homogeneous solutions. See Formulation No. 9 with Neodol 91-2.5® where separation was observed.

Formulations 10–12 reflect the need for a combination of Neodol 25-9® and Neodol 25-3® to achieve homogeneity. Formulations 13–24 investigates variations in the relative concentration of surfactants. Formulations 25–31 illustrate a variety of surfactant combinations which may be useful for the present invention. Formulation 39 demonstrates the effect of eliminating oleic fatty acid. While the solution was homogeneous at room temperature, separation was observed at low temperature. Very high levels of surfactant are also undesirable such as seen in Formulations 42 and 43.

The foregoing description and examples illustrate selected embodiments of the present invention. In light thereof, various modifications will be suggested to one skilled in the art, all of which are within the spirit and purview of this invention.

What is claimed is:

1. An aqueous, clear homogeneous liquid composition comprising:

(a) from 1 to 20% of a mixture of surfactants comprising:

( i) a first nonionic surfactant having an HLB from about 7.9 to less than 10, said first nonionic surfactant being an ethoxylated $C_{12}$–$C_{15}$ alkanol; and (ii) a second nonionic surfactant having an HLB of at least 12, said second nonionic surfactant being an ethoxylated $C_{12}$–$C_{15}$ alkanol;

the ratio of (i) to (ii) being 2:1 to 1:2;

(b) from 1 to 30% of a hydrocarbon solvent; and (c) from 1 to 20% of an alkanolamine salt of a $C_{12}$–$C_{22}$ fatty acid.

2. A composition according to claim 1 further comprising from 0.5 to 20% of a coupling agent.

3. A composition according to claim 2 wherein said coupling agent is selected from the group consisting of $CV_1$–$C_4$ alkanols, sodium $C_1$–$C_4$ alkyl phenol sulfonates and mixtures thereof.

4. A composition according to claim 1 wherein said alkanolamine salt is a triethanolamine salt of oleic acid.

5. A composition according to claim 4 wherein said salt is formed in situ by the reaction of triethanolamine with oleic fatty acid.

6. A composition according to claim 1 further comprising from 0.5 to about 20% of a builder.

7. A composition according to claim 6 wherein said builder is selected from the group consisting of sodium ethylenediaminetetraacetate, sodium citrate, phosphonic acid derivatives and mixtures thereof.

8. A composition according to claim 1 wherein said first nonionic surfactant has an HLB of no higher than 8.

9. A composition according to claim 1 wherein said first surfactant is a $C_{12}$–$C_{15}$ alkanol ethoxylated with an average of about 3 moles ethylene oxide.

10. A composition according to claim 1 wherein said second surfactant has an HLB of at least 13.

11. A composition according to claim 1 wherein said second surfactant is a $C_{12}$–$C_{15}$ alkanol ethoxylated with an average of about 9 moles ethylene oxide.

12. A composition according to claim 1 wherein the ratio of said first to said second surfactant is about 1:1.

13. A composition according to claim 1 wherein said composition further comprises more than 20% of a propellant such that said composition when discharged from an aerosol container will have a foam that alternately expands and collapses for at least two cycles.

14. A composition according to claim 13 wherein the ratio of said propellant relative to all other ingredients combined will range from about 4:1 to 1:4.

15. A composition according to claim 14 wherein the relative ratio ranges from about 4:1 to 2:3.

* * * * *